United States Patent [19]

Ford et al.

[11] 4,253,576

[45] Mar. 3, 1981

[54] BELT FIXTURE AND METHOD OF USING SAME

[75] Inventors: Allan L. Ford, Melrose Park; William A. Cole, Jenkintown, both of Pa.

[73] Assignee: Reborn Products Co., Inc., Elkins Park, Pa.

[21] Appl. No.: 857,330

[22] Filed: Dec. 5, 1977

[51] Int. Cl.³ ..... A47F 5/02

[52] U.S. Cl. ..... 211/60 R; 40/19.5; 211/59.1; 211/163

[58] Field of Search ..... 211/163, 131, 60 R, 211/181, 144, 59.1, 57.1, 54.1, 205, 13; 223/87; 40/19.5

[56] References Cited

U.S. PATENT DOCUMENTS

| | | | |
|---|---|---|---|
| 838,294 | 12/1906 | Zeiner | 211/58 |
| 947,647 | 1/1910 | Palmenberg | 211/59.1 |
| 2,287,418 | 6/1942 | Dudley | 211/59.1 |
| 2,614,698 | 10/1952 | Bell | 211/131 X |
| 3,070,235 | 12/1962 | Manzardo | 211/13 |
| 3,150,778 | 9/1964 | Gurian | 211/181 X |
| 3,202,297 | 8/1965 | Hardy | 211/163 |
| 3,710,996 | 1/1973 | Smilow et al. | 223/87 |
| 3,942,647 | 3/1976 | Crosslen | 211/163 X |
| 3,978,593 | 9/1976 | Pulitzer et al. | 223/87 X |

FOREIGN PATENT DOCUMENTS

| | | | |
|---|---|---|---|
| 767461 | 2/1957 | United Kingdom | 211/13 |

*Primary Examiner*—Francis K. Zugel

*Attorney, Agent, or Firm*—Caesar, Rivise, Bernstein & Cohen, Ltd.

[57] ABSTRACT

A belt fixture comprising a rack having a plurality of segments. Each segment includes a plurality of horizontally extending spokes thereon. Each segment further includes color indicia thereon, with the color of each segment being different from the colors of the other segments. Belts are suspended by hang tags, which are releasably placed on the spokes. The hang tags have the same color as the color applied to its associated segment. The colors are used to segregate belts on the rack by style. The invention further encompasses the method of displaying belts on the rack.

16 Claims, 11 Drawing Figures

FIG. 5
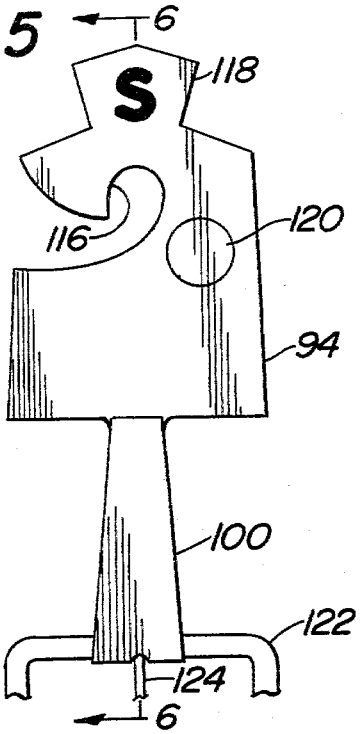
FIG. 6
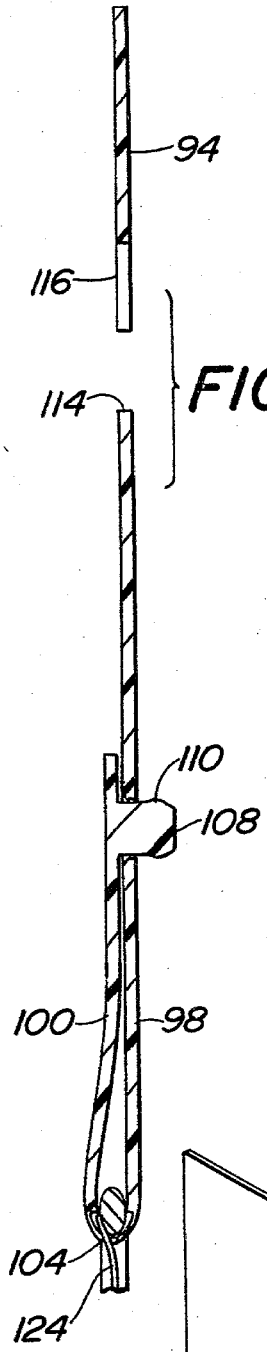
FIG. 7
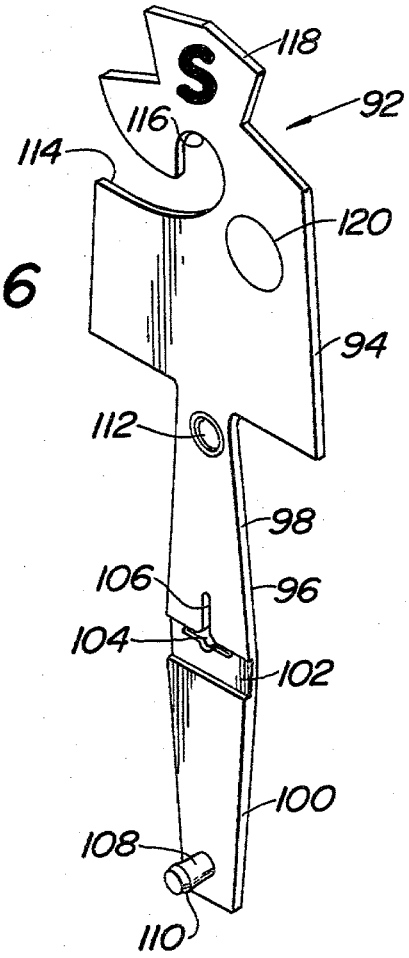
FIG. 8
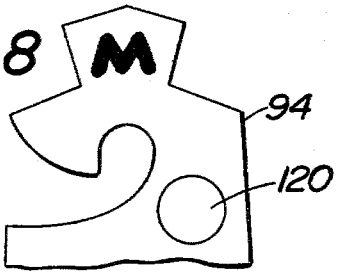
FIG. 9
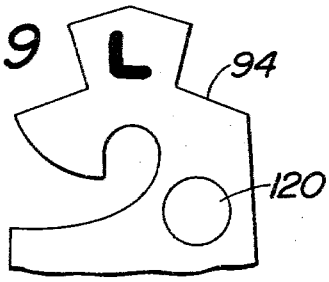
FIG. 10
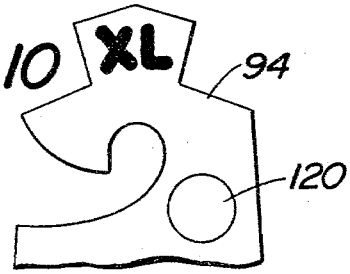
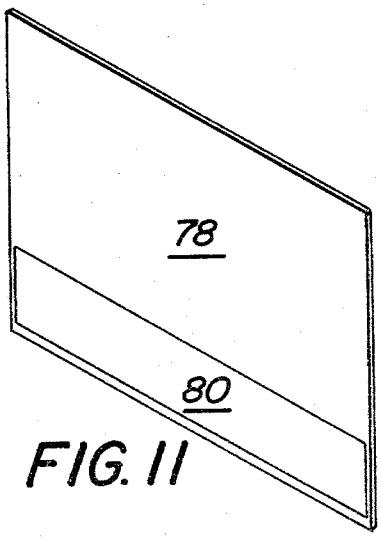
FIG. 11

BELT FIXTURE AND METHOD OF USING SAME

This invention relates to a belt fixture used for displaying and vending belts, and the method of using the same.

Belts are now commonly vended by suspending them from belt racks. Generally, the belts are arranged on the racks by size, with various styles of belts being co-mingled within a given size. The advantage of displaying belts on a rack, as opposed to packaging them in boxes, is that a customer can view the entire belt and try it on without the necessity of having to remove it from a box, and possibly not replace it in the box when placing it back on a counter.

One of the problems of utilizing the belt racks presently in use is that quite often customers will remove the belt from its suspending bar, and replace the belt on a different bar. Quite often, the belt is not replaced with belts of a similar size. This creates a major problem for a store attempting to maintain inventory of given sizes and styles, and in addition, prevents a customer from noticing that a belt in his size is available, since he will only look at belts on the portion of the rack containing his size. It was the recognition of this problem which, in part, led to the instant invention.

One partial solution to the aforementioned problem has been the provision of a color coding system for the belts. Utilizing the color coding system, all of the belts that are on display are provided with a color code which separates belts as to size. For instance, all small belts will be coded brown, all medium belts will be coded yellow, all large belts will be coded red and all extra-large belts will be coded green. In this way, the store can maintain the integrity of the sizes by arranging the belts in their proper colors.

The one problem remaining with the aforementioned coding system is that there is no way of segregating the belts as to style. Thus, sport belts, dress belts, fabric belts, etc. will all be co-mingled under a given size. This creates an inconvenience for the customer who is only looking for a particular style of belt. Furthermore, the store has no ready way of maintaining inventory between different styles because all of the styles are co-mingled within a given size range. The store can accordingly have twelve belts of one style in a given size while having only one belt of a different style in the same size. The device and method of the instant invention readily overcome this problem.

It is accordingly an object of this invention to provide a novel belt fixture.

It is another object of this invention to provide a belt fixture that is adapted to separate belts by both size and style.

It is a further object of this invention to provide a novel method of displaying belts.

These and other objects of this invention are accomplished by providing a belt rack comprising a plurality of sections, with each of said sections having indicia thereon, said indicia comprising a different color for each section, each section having a plurality of spokes thereon and a plurality of hang tags for suspending belts from the spokes, with each hang tag in a given section having the same color as the color indicium of said section, with said colors being used to separate the belts by style.

Other objects and many of the attendant advantages of this invention will be readily appreciated as the same becomes better understood by reference to the following detailed description when considered in connection with the accompanying drawing wherein:

FIG. 5 is a front elevational view of one of the hand tags used in this invention;

FIG. 6 is an enlarged sectional view taken along the line 6—6 of FIG. 5;

FIG. 7 is a perspective view of the hang tag of FIG. 5, in its open condition;

FIG. 8 is a partial front elevational view of a second hang tag used in this invention;

FIG. 9 is a partial front elevational view of a third hang tag used in this invention;

FIG. 10 is a partial front elevational view of a fourth hang tag used in this invention; and FIG. 11 is a perspective view of a display card used on the belt fixture of this invention.

Figure 1:
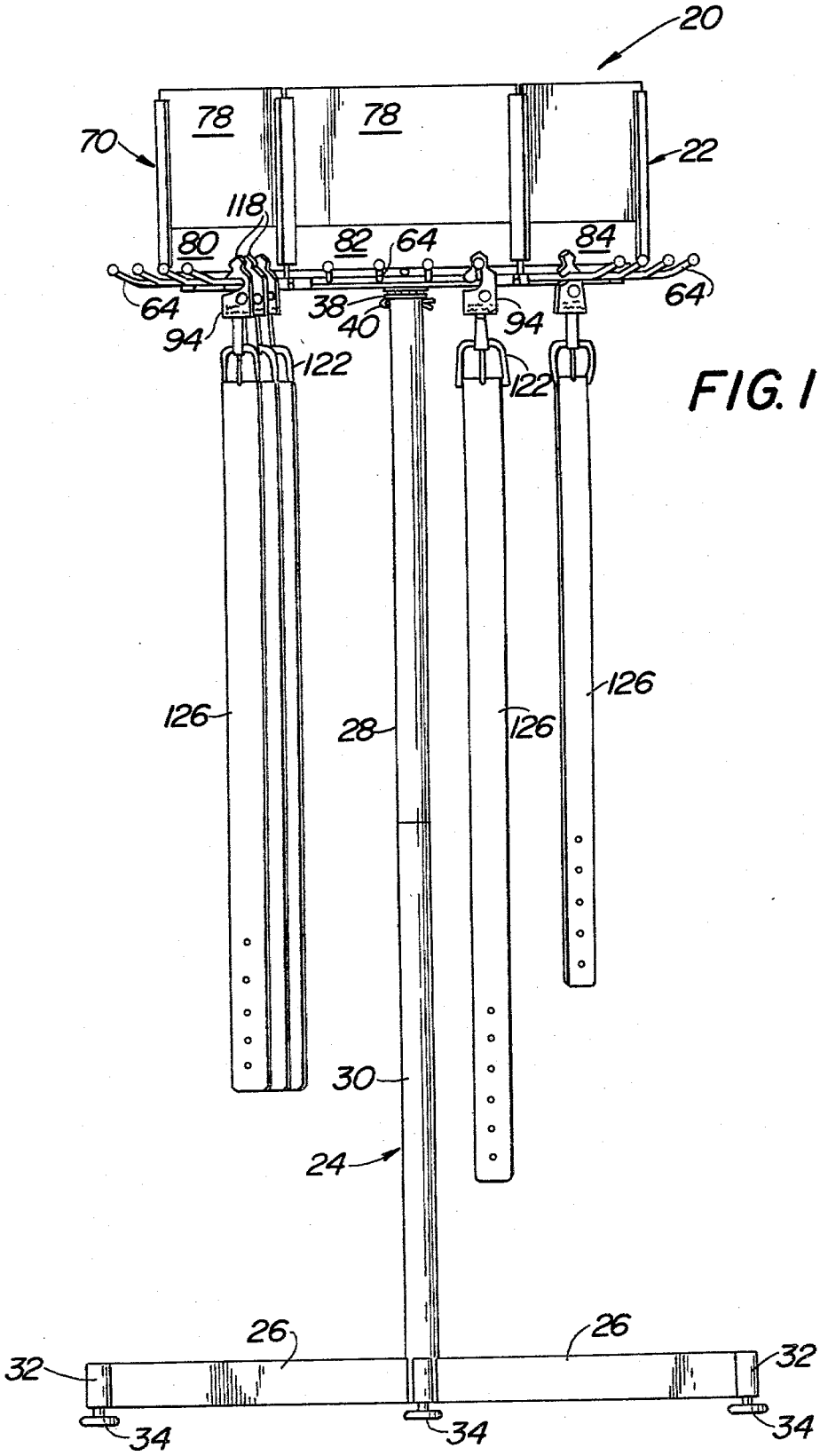
FIG. 1 is a front elevational view of the belt fixture of this invention.

Referring now in greater detail to the various figures of the drawings wherein like reference characters refer to like parts, a belt fixture embodying the present invention is generally shown at 20 in FIG. 1. Device 20 basically comprises a rack 22, a supporting post 24 and a plurality of legs 26.

Post 24 includes an upper tubular section 28 and a lower tubular section 30. The two sections are releasably secured together, as by telescoping a sleeve from the lower section into the hollow tube of the upper section. Four equally spaced legs 26 are secured on the lower section 30, as by welding. An internally threaded boss 32 is formed at the end of each leg 26, and a leveling glide 34 having an upwardly projecting stem is threadedly secured in each boss. By the threaded adjustment of each stem on a glide 34, the horizontal positioning of the rack 22 on post 24 can be assured.

Figure 3:
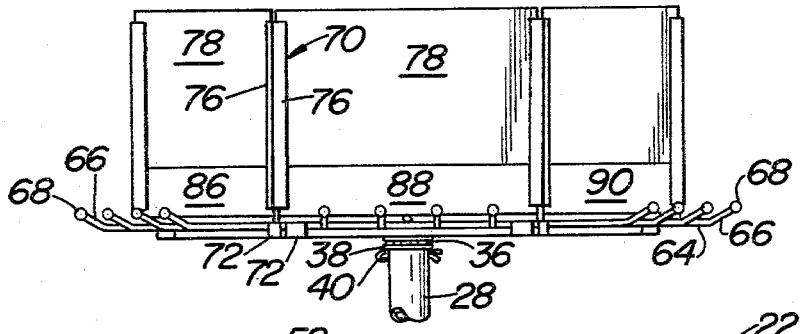
FIG. 3 is a front elevational view of the rack of the belt fixture of this invention, and taken from the side opposite that shown in FIG. 1.
Figure 4:
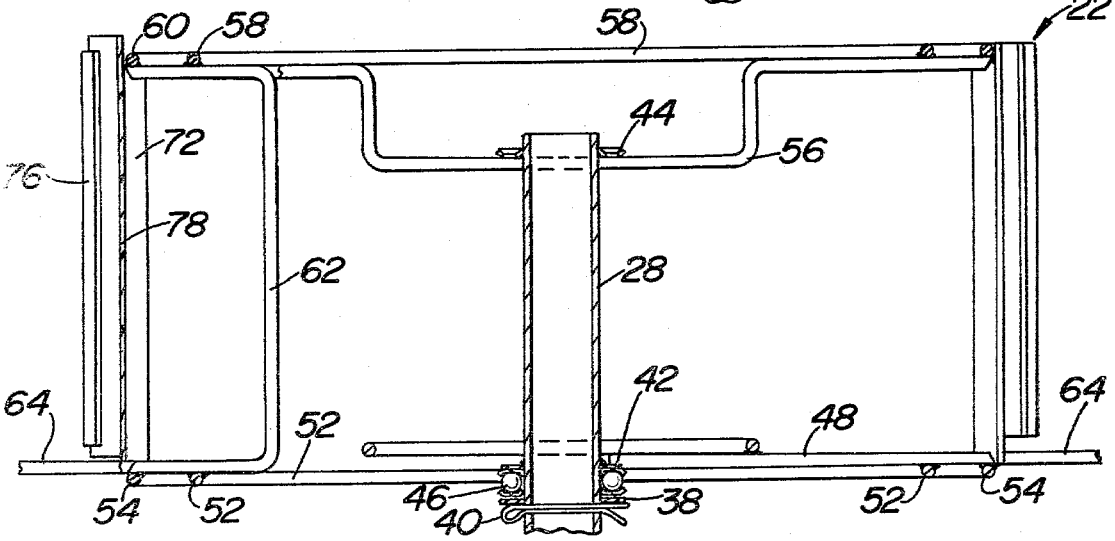
FIG. 4 is an enlarged sectional view taken along the line 4—4 of FIG. 2.

Rack 22 is rotatably mounted on upper section 28 of supporting post 24. This is accomplished by mounting the rack 22 on a ball bearing 36 (FIG. 3) secured on tube 28. The ball bearing 36 rests on a washer 38 which is telescoped over tube 28, and which is held in its position on tube 28 by a cotter pin 40 (FIGS. 3 and 4). Rack 22 includes a lower centrally located ring 42 and an upper centrally located ring 44. In the assembled condition of the fixture 20, the rack 22 is telescoped over the top of tube 28, with the tube passing through rings 42 and 44. As seen in FIG. 4, ring 42 is concave downwardly, thereby forming an annular groove in the ring. The ring functions as an upper race for the balls 46 of ball bearing 36. As seen in FIG. 4, the upper ring 44 is concave downwardly, thereby leaving an upwardly flared inner lip. This aids in seating the rings 44 on tube 28.

As will be explained hereinafter, the rack 22 is built around an axis comprising the rings 42 and 44. Accordingly, the rack 22 will rotate around tube 28. It is supported by cotter pin 40 and associated washer 38. The rack will freely rotate around the ball bearing 36, with the lower ring 42 serving as the upper race of the ball bearing.

Figure 2:
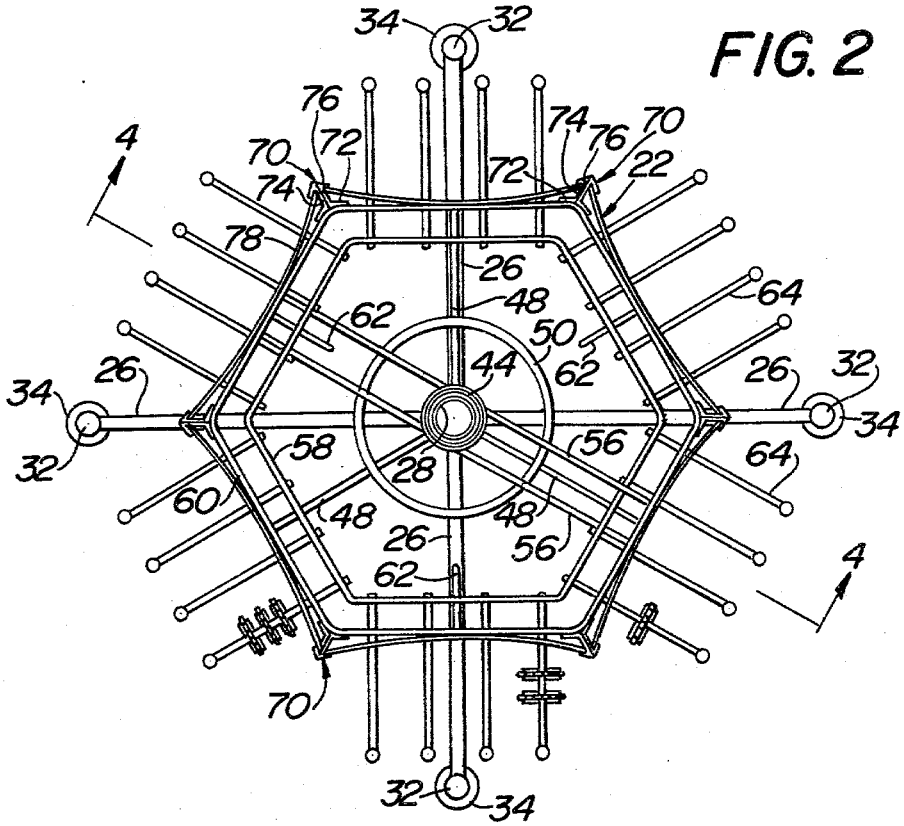
FIG. 2 is a top plan view of the belt fixture of this invention.

Referring to FIGS. 2 and 4, it is seen that lower ring 42 is welded to three radial, equally spaced ribs 48. A ring 50, concentric with ring 42, is welded to the three ribs 48. A pair of concentric hexagonal bars 52 and 54 are welded to ribs 48 (FIG. 4).

As seen in FIGS. 2 and 4, upper ring 44 is welded to a pair of transverse parallel ribs 56. Ribs 56 are welded to a pair of concentric hexagonal bars 58 and 60. In viewing FIG. 2, hexagonal bars 52 and 54 lie directly beneath hexagonal bars 58 and 60, respectively, and are accordingly hidden by the upper bars in FIG. 2. As seen in FIGS. 2 and 4, three equally spaced U-shaped bars 62 are welded to bars 58 and 60 and bars 52 and 54. Four spokes 64 are welded to the underside of each of the six segments of hexagonal bars 52 and 54, and each lies in a plane which is perpendicular to the segments of the horizontal bars to which it is attached. Thus, each spoke 64 of a given segment projects at an acute angle with respect to each spoke 64 on an adjacent segment of bars 52 and 54, as seen in FIG. 2. As seen in FIG. 3, each spoke 64 includes an upwardly bent end 66 having an enlarged ball 68 thereon. The purpose of the bent end and ball is to prevent any of the hang tags, described hereinafter, from sliding off the end of a spoke 64.

A bracket 70 is secured to each pair of aligned apices of the hexagonal bars 54 and 60, as by welding. As seen in FIG. 2, each bracket 70 comprises a pair of plates, with each plate having a rear leg 72, an outwardly projecting leg 74 and an inwardly bent leg 76. Legs 74 in the two plates are contiguous. A display card 78 is mounted between each adjacent pair of brackets 70. Display card 78 can be made of any substantially rigid, but slightly flexible material, such as heavy paperboard, plastic or thin sheet metal. The display card can have printed thereon any identifying material, such as the style of the belt to be displayed, the trademark used with the belt and prices. Each display card has a color band printed thereon, with the color bands being shown at 80, 82, 84 (FIG. 1), 86, 88 and 90 (FIG. 3). Each band has a different color, which, by way of example, are yellow, brown, green, purple, blue and red, respectively. Each card 78 has a width which is slightly greater than the longitudinal distance between the notches formed by inwardly bent legs 76 on a pair of adjacent brackets 70. The cards are inserted between the brackets by bending them and sliding them vertically downward from the top of the brackets into the notches formed in the brackets. The purpose of having the bent cards 78, which are best seen in FIG. 2, is to segregate the six different segments of the rack 22, thereby giving the appearance of individual bins formed by the concave cards 78.

It is thus seen in reviewing FIG. 2 that six different segments are provided in the rack 22. Each segment includes the concave card 78 and the four parallel projecting spokes 64. A different style of belt will be displayed at each of the segments. Various styles that can be displayed are reversible belts, genuine leather belts, hand stained belts, braided belts, covered buckle belts, channel and fancy buckle belts, cloth sport belts, etc. Preferably, the style of belt will be indicated by printing the style on the associated display card 78. A different color band will be associated with each style of belt.

The belts are releasably mounted on the rack 22 through the use of a hang tag, such as that generally shown at 92 in FIG. 7. Hang tag 92 basically comprises a head 94 and an integral dependent strap 96. Strap 96 includes an upper leg 98 and a lower leg 100. Legs 98 and 100 are separated by a recessed area 102 having a slot 104 formed therein. The slot 104 projects upwardly into leg 98, as shown at 106. A nib 108 having an enlarged head 110 is integral with leg 100. Leg 98 has a opening 112 formed therein.

Head 94 includes a slot 114 projecting inwardly from one edge thereof. The slot terminates in a notch 116. A tab 118 forms the upper part of head 94. The tab 118 has engraved therein the size of the belt which is to be attached to the hang tag 92. In the case of the hang tag shown in FIG. 7, the size designation is "S", which is "small". A ring 120 is engraved in head 94. The purpose of ring 120 is to have the price of the belt engraved therein or to receive a price tab adhesively secured thereto. Hang tag 92 can be formed from any substantial, shear-resistant material.

Preferably, it is molded from a substantially rigid, slightly flexible plastic. The hang tag is used by inserting the loop 122 of a belt buckle into recess 102 and folding leg 100 through the loop and against leg 98. The leg 100 is secured in place by snapping nib 108 through opening 112. The enlarged head 110 on the nib will keep the leg 100 in its bent position, as seen in FIG. 6. Thereafter, the tongue 124 of the belt buckle is snapped into slot 104 and is securely held in place therein.

Once the belt has been secured in place on the hang tag 92, the belt can then be placed in its appropriate position on rack 22. This is accomplished by first determining the style of the belt so that the belt can be placed on that segment of the rack for all other belts of that style. This is readily determined by comparing the color of the hang tag 92 with the color bands on cards 78. Thus, there will be a separate colored hang tag for each style of belt. For instance, if the belt is a reversible belt, the hang tag will be yellow. The hang tag is placed on the belt by the manufacturer of the belt. The person filling the rack in a store will simply look at the color of the hang tag, and noting that it is yellow, will place the belt on the left hand spoke 64 projecting from the segment of the rack containing the card 78 having the yellow band 80 thereon (FIG. 1). Thus, all belts which have a size "small" and which have a yellow tag will be placed on the left hand spoke with the yellow color on the card 78. All medium sized belts having a yellow tag will be placed the next spoke, all large sized belts having a yellow tag will be placed on the third spoke from the left and all yellow tagged belts having an extra-large size will be placed on the right hand spoke. In this connection, it should be noted that all of the hang tags 92 are identical in structure, with the only differences being the color and the size designation. In FIG. 8, the head 94 of a medium-sized belt is shown, in FIG. 9 the head 94 on a large-sized belt is shown and in FIG. 10 the head 94 on an extra-large-sized belt is shown.

The sizes for the belts which are shown are conventional size designations. Thus, a "small" size covers a belt ranging in size from 30 to 32 inches (76.2 to 81.3cm), a "medium" size belt covers a belt ranging in size from 34 to 36 inches (86.4 to 91.4 cm), a "large" size belt covers a belt ranging in size from 38 to 40 inches (96.5 to 102 cm) and an "extra-large" size belt covers a belt ranging in size from 42 to 44 inches (107 to 112 cm). There are six colors of hang tags 92, with each color corresponding to the colors 80, 82, 84, 86, 88 and 90 on the display cards 78. In FIG. 11, a perspective view of a display card 78 is shown, with the band being indicated at 80. In this case, the band is yellow.

When a retailer desires to restock the rack 22, he will first be certain the all of the hang tags are placed in their appropriate segments. Thus, all yellow hang tags should be placed on the segment formed by display card 78 having the color yellow (band 80) thereon. He will go through the same routine with the other five colors to be certain that all of the belts of a given style are placed in their proper segments. Thereafter, all of the belts will be arranged on the appropriate spoke 64 so that all belts of a given size can be counted. Once the arrangement has been carried out, the store owner can then readily determine the number of belts in each size for each style, and can readily restock each rack. Furthermore, he can obtain a ready inventory of each size of each style of belt. The entire process of arranging the display, taking an inventory and restocking the display can be carried out in less than ten minutes. The sizes of the belts in any given style are easily determined, since they appear on the upwardly projecting tabs 118, which are readily visible, as is apparent from FIG. 1. A number of belts 126 have been shown in FIG. 1, by way of example. For the purpose of clarity, belts have not been shown as being suspended for all of the spokes 64. However, it should be understood, that during use of the rack 22, belts will be suspended from all of the spokes 64.

The use of the curved cards 78 is an important feature of this invention. The curved card segments each style of belt, and the concavity of the card focuses the customer's attention solely on that style of belt. Additionally, since the spokes 64 in any segment project angularly away from the spokes on the adjacent segment, this will further limit the customer's attention to the belts of a given style. However, if a customer wishes to view all of the belts, since the rack 22 is rotatably mounted on the post 24, the customer can easily rotate the rack to view all of the belts. The ball bearing 36 facilitates this rotation.

The display of FIG. 1 is highly attractive, with the different colored bands on the display cards 78. The rack can be made of any decorative material known to the art. It is preferred that the rack be made of chrome-plated steel, in view of the attractiveness and durability of this material.

The belts are easily placed on the rack 22 or removed therefrom. In order to place the belt on a spoke 24, the hang tag 92 is held beside the spoke 64 and move to the left. The spokes 64 will enter the slot 114, and when the hang tag 92 is released, the spoke will be engaged in the notch 116. The balls 68 at the ends of spokes 64 prevent the belts from inadvertently sliding off their associates spokes. However, when a customer desires to try on or view a particular belt, he merely has to lift the hang tag 92 and pull it to the right in order to remove it from the spoke. If the customer does not purchase the belt, he can easily replace the belt on the spoke 64 in the same manner as is done when stocking the belt, as described above.

As an optional feature of the invention, all of the belts in a given segment can also be of the same price, as well as being of the same style. Thus, the customer can shop for his belts by price, as well as shopping for them by style. The prices are placed on the ring 120 in head 94, as explained above. If all of the belts in a given segment are of the same price, the price can also be imprinted on the display card 78.

Without further elaboration, the foregoing will so fully illustrate my invention, that others may, by applying current or future knowledge, readily adapt the same for use under various conditions of service.

We claim:

1. A belt rack comprising a plurality of sections, with each of said sections having indicia thereon, said indicia comprising a different color for each section, each section having a plurality of spokes thereon, a plurality of hang tags for suspending belts from the spokes, with each hang tag in a given section having the same color as the color indicium of said section, with said colors being used to distinguish the belts by style and a belt suspended by each hang tag.

2. The belt rack of claim 1, wherein said belt rack is rotatably mounted.

3. The belt rack of claim 2 wherein said belt rack is rotatably mounted on a vertical post.

4. The belt rack of claim 1 wherein said color indicia are present on a display card mounted in said section.

5. The belt rack of claim 4 wherein said display card is concave relative to said spokes, whereby said display card aids in focusing attention on the belts on said spokes.

6. The belt rack of claim 1 wherein the spokes in any section are adapted to support belts of a given size, with there being as many spokes per section as there are different sizes of belts.

7. The belt rack of claim 6 wherein there are four spokes per section, with said spokes adapted to receive belts having the sizes "small", "medium", "large" and "extra-large", respectively.

8. The belt rack of claim 6 wherein said hang tags have the size designation of the belt to be supported thereby thereon.

9. The belt rack of claim 8 wherein said size designation is positioned at the top of each hang tag, so that it is readily visible.

10. The belt rack of claim 1 wherein said rack has a central hub and said sections are formed into a regular geometric shape around said hub, each of said sections comprising a substantially planar face, with each planar face projecting angularly from the adjacent planar face, and with each of said planar faces being perpendicular to a radius emanating from said hub.

11. The belt rack of claim 10 wherein said planar faces are arranged in the shape of a hexagon.

12. The belt rack of claim 10 wherein the spokes of each section project perpendicularly to their planar face.

13. The belt rack of claim 10 wherein said planar faces are formed by vertically spaced, parallel bars.

14. The belt rack of claim 10 wherein means are provided on each of said planar faces for securing a display card thereon, said display card carrying said color indicia.

15. The belt rack of claim 14 wherein said display card is slightly concave relative to said spokes, whereby said display card serves to focus attention on the belts suspended from said spokes at the section wherein the display card is positioned.

16. The belt rack of claim 1 wherein all of the belts in a given section have the same price.

* * * * *